US005387297A

United States Patent [19]

Damavarapu et al.

[11] Patent Number: 5,387,297

[45] Date of Patent: Feb. 7, 1995

[54] 2,4-DINITROIMIDAZOLE- A LESS SENSITIVE EXPLOSIVE AND PROPELLANT MADE BY THERMAL REARRANGEMENT OF MOLTEN 1,4 DINITROIMIDAZOLE

[75] Inventors: Reddy Damavarapu, Hackettstown; Keerti Jayasuriya; Theodore Vladimiroff, both of Newton; Sury Iyer, Randolph, all of N.J.

[73] Assignee: The United States of America as represented by the Secretary of the Army, Washington, D.C.

[21] Appl. No.: 170,654

[22] Filed: Nov. 26, 1993

Related U.S. Application Data

[63] Continuation of Ser. No. 949,914, Sep. 24, 1992, abandoned.

[51] Int. Cl.[6] ..... C07D 487; C07D 100; D03D 23/00; D03D 43/00

[52] U.S. Cl. ..... 149/109.6; 548/327.5

[58] Field of Search ..... 149/47, 46, 109.6; 548/327.5

[56] References Cited

U.S. PATENT DOCUMENTS 4,300,962 11/1981 Stinecipher et al. ..... 149/47

OTHER PUBLICATIONS

Grimmett et al. 1,4 DNI and Derivatives, Aust. J. Chem., 42(8), 1281–9, 1989.

Suwinski et al. Nitroimidazoles, Part IX Some reactions of 1,4 DNI's, Pol. J. Chem., 61(7–12), 913–20, 1987.

Sharnin et al. 2,4 Dinitroimidazole, Otkrytiya, Izobret., *Prom. Obraztsy, Tovarnye Znaki* 54(2), 1975.

*Primary Examiner*—Donald P. Walsh

*Assistant Examiner*—Anthony R. Chi

*Attorney, Agent, or Firm*—Anthony T. Lane; Edward Goldberg; John E. Callaghan

[57] ABSTRACT

The compound 2,4-dinitroimidazole is highly insensitive towards impact and its thermal stability is excellent. The calculated detonation properties results indicate that its performance is about 30% better than TATB. It can be prepared easily with good yield starting from inexpensive starting materials. Results from impact sensitivity, friction sensitivity time-to-explosion temperature and vacuum stability tests indicate that 2,4-dinitroimidazole is less sensitive than both RDX and HMX. Its good oxygen balance and measured heat of formation data of this material indicate that its propellant performance is good.

5 Claims, No Drawings

2,4-DINITROIMIDAZOLE- A LESS SENSITIVE EXPLOSIVE AND PROPELLANT MADE BY THERMAL REARRANGEMENT OF MOLTEN 1,4 DINITROIMIDAZOLE

The invention describede herein may be manufactured, used and licensed by or for the U.S. Government.

This is a continuation of Ser. No. 07/949,914, filed Sep. 24, 1992, now abandoned.

FIELD OF USE

The invention described herein relates to energetic material for use as a chemical explosive and propellant.

BACKGROUND OF THE INVENTION

In modern ordnance there is a strong requirement for explosives having both good thermal stability, impact insensitivity and explosive performance. However, these requirements are somewhat mutually exclusive. Those explosives having good thermal stability and impact insensitivity exhibit poorer explosive performances and vice versa. This energetic material, crystalline 2,4-dinitroimidazole, (Crystalline DNI-24) we have discovered has both good thermal stability and impact insensitivity, as will be described and documented hereinafter. The explosive of the prior art are generally less attractive and, unwanted because of many unintentional initiations of munitions by either impact or shock aboard cargo ships, aircraft carriers, ammunition trains and nuclear warheads. Triaminotrinitrobenzene (TATB) is currently employed for insensitive high explosive applications in nuclear weapons, but this explosive does not provide sufficiently high energetic performance in order to replace RDX and HMX in some applications. Therefore, there is a continuing need for explosives which are powerful, yet resistant to accidental and sympathetic initiation.

The compound 2,4-dinitroimidazole (DNI-24) is known in the literature. Although these imidazole derivatives were studied exclusively for their pharamacological medicinal chemistry, the nitro derivatives of this heterocyclic system were not studied for their use in explosives and propellants applications. There is nothing in the literature, however, which in any way suggests either any explosive or propellant properties or the thermal stability and impact insensitivity of 2,4-dinitroimidazole (DNI-24) and its isomer 1,4-dinitroimidazole (DNI-14). As a part of a program to develop more powerful explosives and propellants, we have discovered that the crystalline DNI-24 is energetic for propellant and explosives applications based on experimental results.

The starting point for the synthesis of these two targeted compounds is Imidazole and this is commercially available from Fluka Chemical Company, Ronkonkoma, N.Y. This can be nitrated to give the 4-nitroimidazole wish in good yield. The nitro group on 4-nitroimidazole becomes the initiating point for introducing further nitro groups.

SUMMARY OF THE INVENTION

To achieve the foregoing and other objects, and in accordance with the purposes of the present invention, as embodied and broadly described herein, the method hereof includes the step of detonating the energetic material, which we have discovered has these properties. In other words, crystalline DNI-24 can be initiated as an explosive or propellant to give powerful explosion or propulsion. Yet, this material is highly insensitive to impact and shock, which is an extraordinary discovery.

Benefits and advantages of the subject method include decreased sensitivity of the material, crystalline DNI-24, utilized to detonation by shock and impact when compared to that of RDX and TNT, while providing a high detonation pressure, which is equivalent or superior to the aforesaid. We have found that the compound, crystalline DNI-24, has an explosive performance comparable to, that of RDX, but a thermal stability and impact insensitivity which is significantly better. While the impact insensitivity of crystalline DNI-24 is comparable to TATB, its explosive performance is substantially better than TATB. The compound crystalline DNI-24 also has superior propellant performance, which is proven by initial experimental results. In theory, the reason for this is believed to be that the compound is perfectly oxygen balanced towards CO, $H_2O$ and $N_2$ molecules. In propellant applications, low molecular weight gaseous products are desirable. The invention as described here allows the preparation of highly insensitive, thermally stable compositions containing DNI-24 from low melting, castable DNI-14, which is substantially more sensitive. The impact insensitivity, vacuum stability and explosion temperature data shows crystalline DNI-24 to be a highly insensitive energetic material for explosive and propellant applications with excellent thermal stability and explosive performance.

DESCRIPTION OF THE PREFERRED EMBODIMENTS

The following examples illustrate specific embodiments of the method of carrying out the process and applications as insensitive explosive and propellant. It is to be understood that they are illustrative only and do not in any way limit the invention.

EXAMPLE 1

Preparation of 1,4-dinitroimidazole:

4-nitroimidazole ( 8.87 gms.) obtained from Fluka Chemical Company, Ronkonkoma, N.Y, dissolved in 17.8 ml of glacial acetic acid and the mixture was cooled to 0° C. To this mixture, 4.8 ml. of Nitric acid (98%) (density=1.52 gm/cc) was added dropwise over a period of 30 min. stirring continuously, while keeping the temperature below 5° C.. To this mixture, acetic anhydride ( 15 ml) was added dropwise while stirring at 0° C. for 2 hr. The mixture is then stirred at room temperature for another 8 hrs.. The mixture turns golden yellow color, which was then poured onto crushed ice, stirred and filtered, dried to get 8.5 grms. of 1,4-dinitroimidazole having a melting point of 92° C. corresponding to the reported melting point in the literature. The structure was further confirmed by NMR ($^1H$ NMR, in $CDCl_3$, 9.0 and 9.4 ) and Mass (M+ 158) Spectroscopy techniques.

EXAMPLE 2

Preparation of 1,4-dinitroimidazole:

4-nitroimidazole (88 gms.) obtained from Fluka Chemical Company, Ronkonkoma, N.Y, was dissolved in glacial acetic acid (240 ml ) and acetic anhydride (120 ml). Nitric acid (98%, 80 ml. density=1.52 gm/cc) was added dropwise while continuously stirring the mixture over a period of 60 min. The mixture is then stirred at room temperature for another 3 hrs.. The mixture gradually turned into a golden yellow color solution. This solution was poured onto crushed ice, stirred for about 1 hour and filtered the precipitate. The sample was dried completely, and 85 grms. of 1,4 -dinitroimidazole was recovered having a melting point of 92° C. corresponding to the reported melting point in the literature. The structure was further confirmed by NMR ($^1$H NMR, in $CDCl_3$, 9.0 and 9.4 ) and Mass (M+ 158) Spectroscopy techniques.

EXAMPLE 3

Preparation of 2,4-dinitro imidazole 2.3. grms of 1,4-dinitroimidazole (DNI-14) in 40 ml of chlorobenzene was heated while stirring at 120°–125° C. for 4 hrs. The solution was cooled, and the precipitate was filtered and dried to yield 2.1 gms. of amorphous powder 2,4-dinitroimidazole (amorphous powder DNI-24) having a melting point of 264°–267° C. corresponding to the reported melting point in the literature. The structure was further confirmed by NMR (1H NMR, in $CDCl_3$, 8.6 and 11.7) and Mass ( M+ 158) Spectroscopy techniques.

EXAMPLE 4

Preparation of 2,4-dinitroimidazole (DNI-24) by thermal rearrangement 2 gms. of 1,4-dinitroimidazole (DNI-14) was placed in an open beaker and slowly heated to 95°–98° C. for 25 min. The compound melted at this temperature. It was then cooled to room temperature. The smooth transformation of the DNI-14 to amorphous powder DNI-24 was observed. The product was confirmed by the melting point, NMR ($^1$H NMR, in $CDCl_3$, 8.6 and 11.7) and Mass ( M+ 158) Spectroscopy techniques.

EXAMPLE 5

Recrystallization of amorphous powder 2,4-dinitroimidazole (amorphous powder DNI-24)

A 10 gm sample of amorphous powder DNI-24 was dissolved in 200 ml. of hot acetonitrile (boiling point 80°–81° C.). The solution was then cooled to room temperature to obtain DNI-24 crystals, which was filtered and air dried.

Sensitivity Results

A sample of amorphous powder DNI-24 was tested for its impact sensitivity by dropping a 2.5 kg weight object at various heights. No detonations were recorded in eight trials conducted at heights of 50, 60, 70, 80, 90, 120, 150 and 200 cm.

Method of Use

Proof of Energetic Character

A recrystalllised sample of DNI-24 was tested for its energetic character by dropping a 2.5 kg weight object at various heights. At heights above 100 cm, a powerful detonation was observed of this material. This proves that DNI-24 is an energetic material, which can be used as explosive or propellant material.

The Following evidence will show that the Impact and Friction sensitivity of crystalline DNI-24 is greater than HMX.

| Compound | Impact Sensitivity (cm) | Friction Sensitivity (kg) |
|---|---|---|
| HMX | 25 | 10 |
| RDX | 30 | |
| TNT | 65 | 6 |
| DNI-24 (crystalline) | >100 | 14 |

As the evidence shows bellow, our compound crystalline 2,4-dinitroimidazole (crystalline DNI-24) is greater than TATB and TNT in energy performance and slightly less than HMX.

| Compound | Energy Performance with respect to HMX (calculated) |
|---|---|
| HMX | 1.0 |
| RDX | 0.9 |
| DNI-24 (crystalline) | 0.8 |
| TATB | 0.6 |
| TNT | 0.5 |

What we claimed is:

1. A process for the preparation of 2,4 dinitroimidazole (DNI-24) consisting essentially of melting 1,4-dinitroimidazole (DNI-14) and maintaining said molten condition while said DNI-14 undergoes a thermal rearrangement to said DNI-24.

2. The process of claim 1 wherein the rearrangement is conducted at a temperature of about 95 to 98 degrees Celsius.

3. The process of claim 1 wherein the rearrangement is conducted at a temperature of about the melting point of DNI-14.

4. In a process of making an article of manufacture wherein the article contains an explosive or propellant and is adapted for use as ordnance, the improvement comprising melting 1,4-dinitroimidazole (DNI-14) and maintaining said molten condition so that said DNI-14 undergoes a thermal rearrangement to DNI-24 in an amount sufficient to provide a thermally stable, shock insensitive, powerful energetic composition as the explosive or propellant.

5. The article produced by the process of claim 4.

* * * * *